US005931571A

United States Patent [19]

Chi

[11] Patent Number: 5,931,571

[45] Date of Patent: Aug. 3, 1999

[54] STRUCTURE OF ALARM LAMP

[76] Inventor: Yu-Tsang Chi, No. 65, Ho Ping Road, Lu Chou Country, Taipei Hsien, Taiwan

[21] Appl. No.: 08/891,293

[22] Filed: Jul. 10, 1997

[51] Int. Cl.[6] ..... F21V 15/04

[52] U.S. Cl. ..... 362/390; 362/249

[58] Field of Search ..... 362/390, 369, 362/431

[56] References Cited

U.S. PATENT DOCUMENTS 4,954,936 9/1990 Kawabata et al. ..... 362/390

*Primary Examiner*—Sandra O'Shea
*Assistant Examiner*—Todd Reed Hopper
*Attorney, Agent, or Firm*—Rosenberg, Klein & Bilker

[57] ABSTRACT

The present invention is related to an improved structure of an alarm lamp which is installed on all types of finishing mechanisms, for example, working machines, lathes, stands and other machines. A shock proof structure having a shock proof effect is additionally added to the lower part of said alarm lamp. The assembled structure is combined on a pillar, and then the pillar and associated installing structures are installed at a proper position on a finishing machine. The shock proof structure is formed by a shock proof base, elastic bodies, and a case of said shock proof base, wherein said shock proof base is connected under the combining base of the alarm lamp body. A plurality of elastic bodies are individually installed within openings of a fixing disk of the shock proof base and within openings of the case of said shock proof base. The two layers of overlapped elastic bodies are matched with each other. Thus, the vibration resulting from the operation of the machine may be substantially reduced and the lifetime of the lamp thereby prolonged.

1 Claim, 7 Drawing Sheets

STRUCTURE OF ALARM LAMP

BACKGROUND OF THE INVENTION

1. Field of the Invention

The present invention is related to an improved structure of an alarm lamp, in which a shock proof structure is added to an alarm installed on a finishing machine lamp for reducing vibration. A plurality of elastic bodies are installed within the openings of the fixing disk of the shock proof base and the openings of a case of the shock proof base. After assembly, a two layer overlapped structure will be formed by the device, similar to that of a shock absorber. After the machine has been actuated and the alarm lamp is oscillated, the oscillation will be properly absorbed by the two layers of elastic bodies to reduce the oscillation of the lamp, thereby sustaining the life and stability of the lamp.

2. Prior Art

Since the industrialization and promotion of technology, all kinds of finishing machines have been further improved. In order to sustain the usage of the finishing machines, other than by the functions of the machines themselves, other alarm systems may be attached to the machines. Alarm lamps are generally used on automatic finishing machines, for example, in an automatic assembly line to alert the operator to pay attention. However, in order to sustain the assembly line flow of the automatic machines and not effect the function of the machines themselves, the element of this added function is required to be (1) useful, and (2) compact and light weight.

Referring to FIGS. 6 and 7, an alarm lamp usually used on automatic finishing machines is shown. The alarm lamp has a plurality of lamp bases (7) which are fixed together with bolts (71), and then they are added to an automatic machine for finishing. In this structure, the mechanical elements are combined together directly with rigid contacts being formed therebetween. Once the finishing machine is used, a resonance will be induced due to the oscillation of the machine itself. This will further cause the lamp on the lamp base (7) to be easily displaced and form a poor electrical contact. This prior alarm lamp is often destroyed, yet it is needed to indicate the machine's performance and engagement. Thus, labor is wasted and danger to operators is increased.

SUMMARY OF THE INVENTION

The main object of the present invention is to provide an improved structure of an alarm lamp, where a shock proof structure is installed under the alarm lamp and then the shock proof structure is added to a finishing machine. Once the finishing machine is used, the oscillation induced by the machine will be absorbed by the shock proof structure and not transferred to the lamp, thus the lifetime thereof will be increased.

A further object of the present invention is to provide an improved structure of an alarm lamp, wherein the shock proof structure has two layers of elastic bodies which are installed on the shock proof base of the shock proof structure and the shock proof base of the case. As the finishing machine is oscillated, the stability of the base itself is still retained, thus the usability of the machine is increased.

BRIEF DESCRIPTION OF THE DRAWINGS

The invention, as well as its many advantages, may be further understood by the following description and drawings in which.

DETAILED DESCRIPTION OF THE PREFERRED EMBODIMENT

Figure 1:
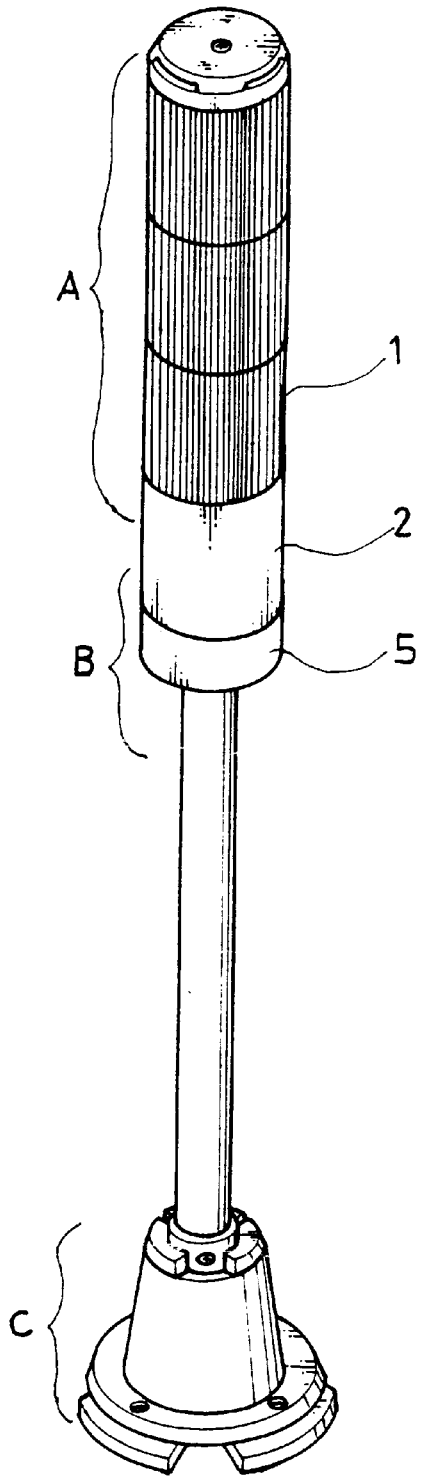
FIG. 1 is a perspective view of the present invention.
Figure 2:
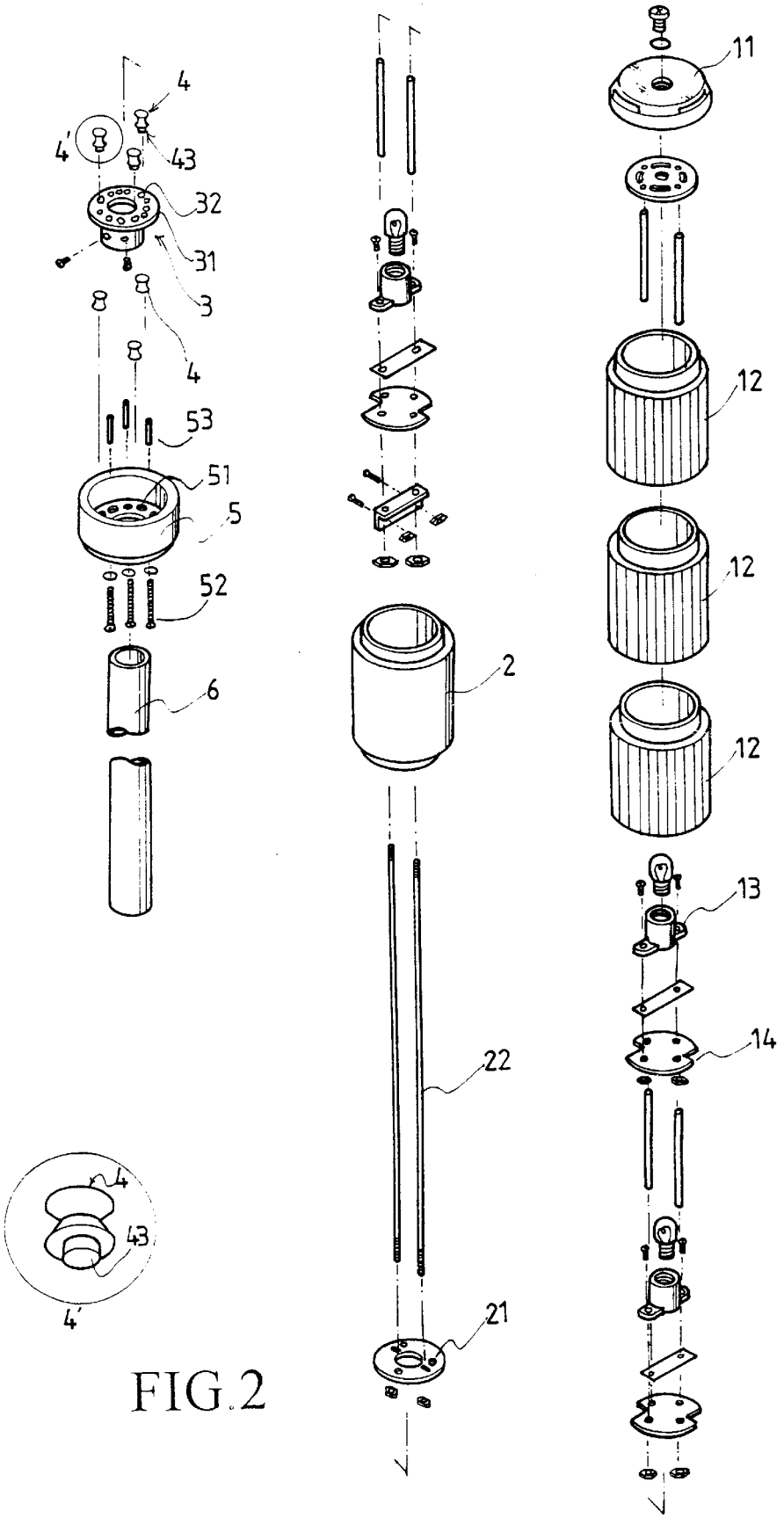
FIG. 2 is an exploded perspective view of the present invention.

FIG. 1 shows the appearance of the present invention. It is appreciated that the present invention is mainly comprised of a lamp body A and a shock proof structure B. Now also referring to FIG. 2, the lamp body A is constructed from a lamp 1 comprising a plurality of lampshades 12. The number of lamp bulbs of lamp 1 is chosen according to practical requirements and the lamp 1 is constructed from multiple lampshades 12 (for example, in this embodiment, the number of lampshades is three). A small lamp base 13 is installed in each of the lampshades 12. Each lamp base is installed to a combining base 14, as is done in the prior art, and then it is arranged into a base 2 to form the lamp body A.

The shock proof structure of the present invention is located below the lamp body A. This shock proof structure B is mainly comprised of a shock proof base 3, a plurality of elastic pieces 4 and the case 5 of the shock proof base. Wherein the shock proof base has a circular shape, and a fixing disk 31 extending outwardly therefrom, forming a T-shaped cross-sectional contour. A plurality of equally spaced openings 32 are formed in the fixing disk. A plurality of screw holes are installed on the outside of a pillar which is extended outwardly therefrom.

The number of elastic pieces is matched to the number of openings 32 of the fixing disk 31 (in the Figure, twelve openings are shown, as an example). Referring to the enlarged Figure, the elastic bodies 4 have a structure which is similar to the line shaft, and the upper and lower part thereof is divided into upper and lower rims with a funnel shape 41 and 42, respectively, while a projection is formed on the bottom surface of the lower rim 42. The size of the projection 43 is matched to that of the openings 32 of the fixing disk 31. The projection may be inserted into a respective opening 32, thus they will engage tightly therein. Since the elastic bodies 4 are elastic members, therefore, a slight force is needed to insert the projection into the opening 32. However, once the projection has been inserted, it is not easy to withdraw the projection from the opening.

The case 5 of the shock proof base is used to install the shock proof base 3, and there are a plurality of openings 51 (shown in FIGS. 2 and 4) formed in the bottom thereof. Similarly, a plurality of elastic bodies 4, in equal number, are inserted into the openings 51. Accordingly, when the shock proof base 3 is located within said case 5, two layers of elastic bodies 4 are formed and that structure has a preferred shock proof effect.

Figure 3:
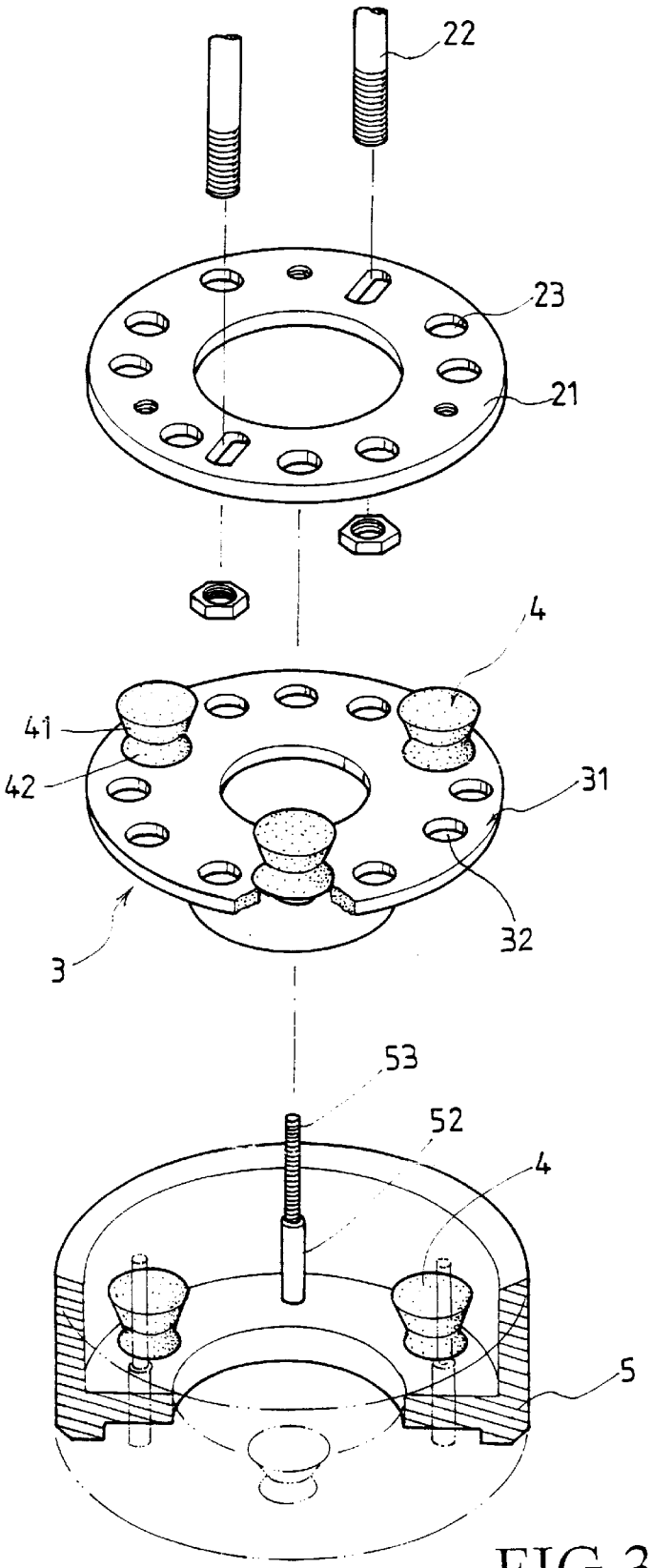
FIG. 3 is an exploded perspective view of the shock proof structure of the present invention.
Figure 4:
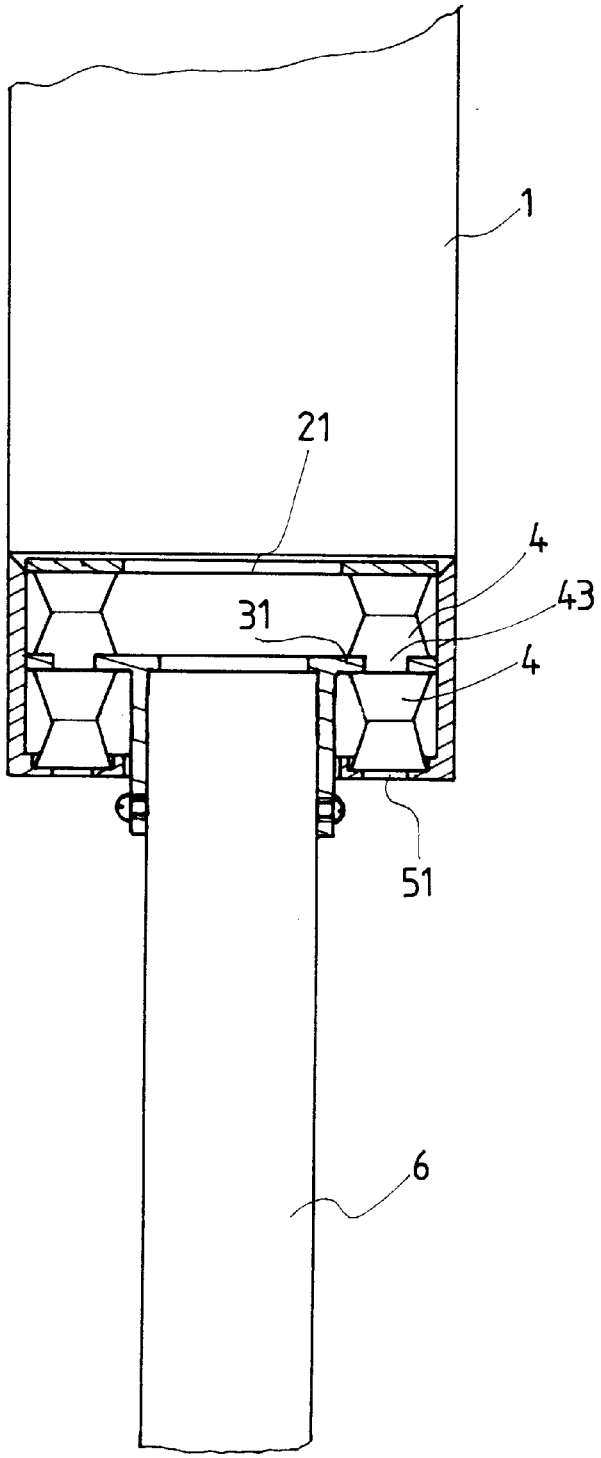
FIG. 4 is a partial cross-sectional view of the shock proof structure of the present invention after assembling.

In the assembly of the present invention, as shown in FIG. 3, the buckling disk 21 and the base 2 are combined by bolts 22 and nuts. The buckling disk 21 and the shock proof base 3 are combined in the case 5 by bolts 53, and then the shock proof base 3 is assembled to a pillar 6 as shown in FIG. 4. The elastic bodies 4 are installed in the openings 51 of the case 5, surrounding the pillar 6. Meanwhile, the elastic bodies 4 on another layer are attached within the openings 32 of said fixing disk 31 of the shock proof base 3. The height of the shock proof structure is regulated by the bushings 52 and the bolts 53 on the bottom of the case 5. By that arrangement, the structure is properly located at the lower side of the lamp body A through the two layers of elastic bodies 4, thereby forming a preferred shock proof effect.

The lamp body of the present invention may be assembled by many ways. However, one preferred method is shown in FIG. 1, wherein the whole structure is fixed on a machine through a fixing base C. However, that embodiment is not intended to confine the application of the present invention.

Figure 5:
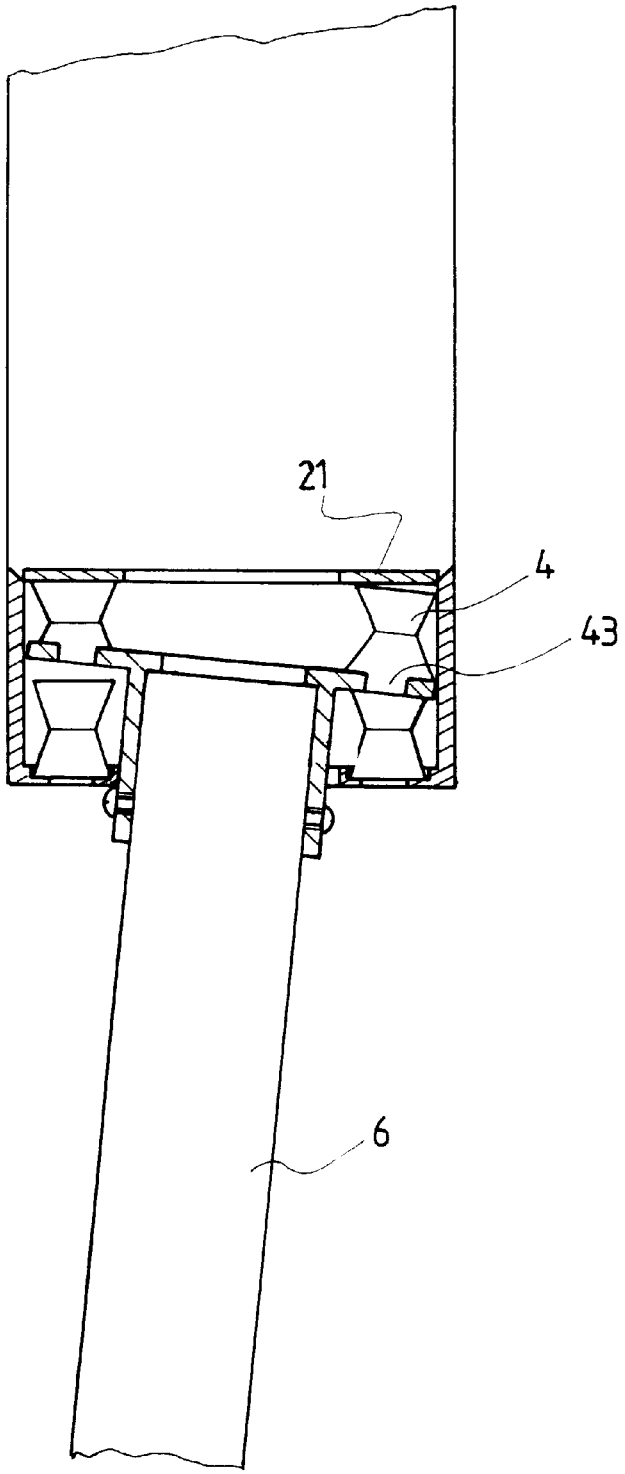
FIG. 5 is a cross-sectional view of the present invention showing operation of the shock proof structure.
Figure 6:
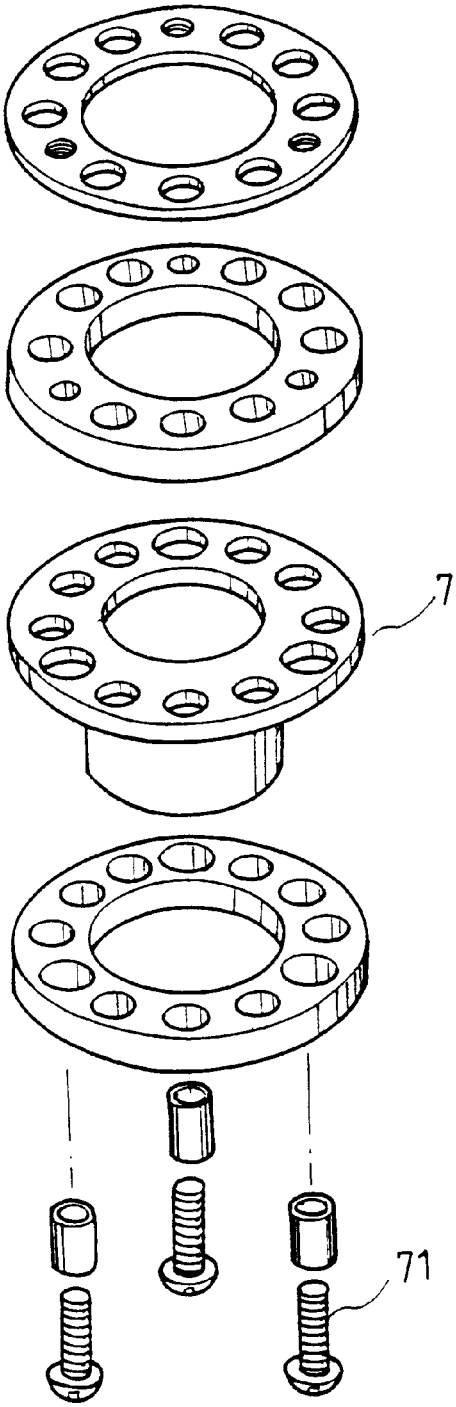
FIG. 6 is a perspective exploded view of a prior structure.
Figure 7:
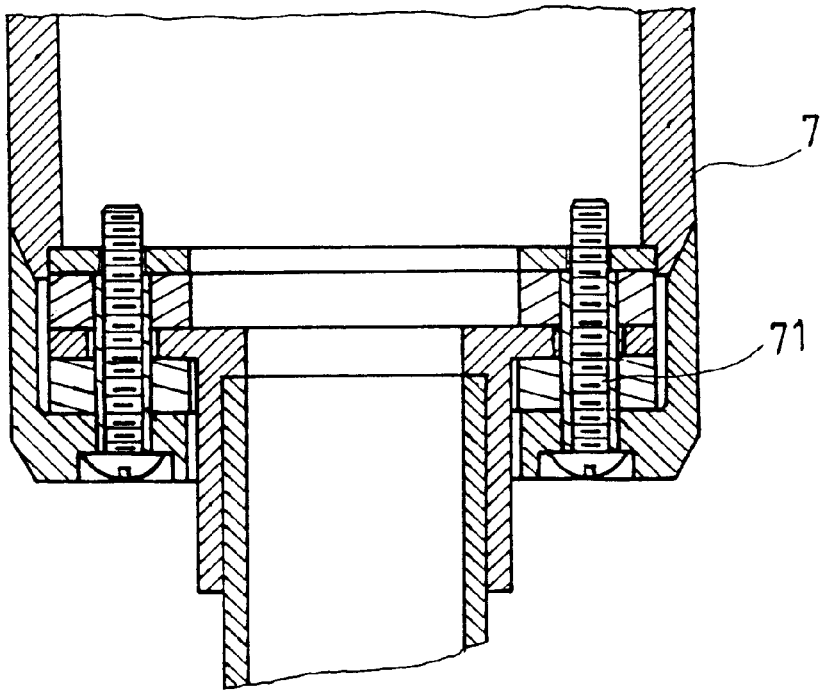
FIG. 7 is a cross-sectional view of the prior structure.

In using a finishing mechanism, big shocks are probably induced. Once the shock is generated, the lamp body fixed to the chassis will probably oscillate with the mechanism. Now, by virtue of the shock proof structure B of the present invention, most of the oscillations can be absorbed by the elastic bodies 4. As shown in FIG. 5, even if the oscillation is large enough so that the pillar 6 may be shifted away from its original position, the elastic bodies may properly reduce the shock by their elastic property. Thus, the oscillation will be prevented from transferring to the lamp body A, prolonging the lifetime of said lamp body.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved alarm lamp structure, comprising:

a lamp body having (a) a base, (b) a plurality of lampshades coupled to said base, (c) a plurality of lamp bases respectively installed in said lamp shades, (d) a buckling disk disposed in said base, and (e) a plurality of fasteners coupled to said buckling disk for securing said plurality of lamp shades to said base; and, a shock proof structure coupled to said buckling disk, said shock proof structure including (a) a case having a plurality of through openings formed in a bottom portion thereof, (b) a plurality of first elastic bodies disposed in said bottom portion of said case in correspondence with at least a portion of said through openings of said case, each of said first elastic bodies having a portion intermediate opposing longitudinal ends thereof with a diameter less than a diameter of said longitudinal ends, (c) a shock proof base member disposed in said case and having a central opening for receiving a pillar therein and a fixing disk on one end thereof, said fixing disk having a plurality of through openings formed therein, (d) a plurality of second elastic bodies disposed on said fixing disk in correspondence with at least a portion of said through openings of said fixing disk and said plurality of first elastic bodies, each of said second elastic bodies having a portion intermediate opposing longitudinal ends thereof with a diameter less than a diameter of said longitudinal ends, each of said second elastic bodies having a projection formed on one of said longitudinal ends, said projection being inserted into a respective through opening of said fixing disk for engagement of said second elastic body thereto, and (e) a plurality of threaded fasteners passing through a respective portion of said plurality of through openings in said case and in said fixing disk and being threadedly engaged to said buckling disk.

* * * * *